United States Patent [19]

Kroll

[11] Patent Number: 4,474,680

[45] Date of Patent: Oct. 2, 1984

[54] FOAM GENERATING APPARATUS AND METHOD

[75] Inventor: John J. Kroll, Calgary, Canada

[73] Assignee: Valerin Technologies Limited, Malvern, Pa.

[21] Appl. No.: 474,776

[22] Filed: Mar. 14, 1983

[51] Int. Cl.[3] ..... B01F 3/04; B01F 5/10

[52] U.S. Cl. ..... 252/307; 252/359 R; 261/DIG. 26; 169/64; 169/15; 239/8

[58] Field of Search ..... 252/307, 359 R, 88; 261/DIG. 26, 26; 169/15, 64; 239/8

[56] References Cited

U.S. PATENT DOCUMENTS

| | | | |
|---|---|---|---|
| 3,120,927 | 2/1964 | Holland | 239/124 |
| 3,811,660 | 5/1974 | Cole, Jr. | 261/18 B |
| 4,030,488 | 6/1977 | Hasty | 128/24 R |
| 4,137,048 | 1/1979 | Steinman | 261/DIG. 26 |
| 4,213,936 | 7/1980 | Lodrick | 261/DIG. 26 |
| 4,316,875 | 2/1982 | Barth et al. | 261/DIG. 26 |
| 4,366,081 | 12/1982 | Hull | 261/DIG. 26 |
| 4,400,220 | 8/1983 | Cole, Jr. | 134/18 |

OTHER PUBLICATIONS

Fire Protection Handbook, 15th Ed., National Fire Protection Association, (1981), Chapter 18, pp. 30–43.

*Primary Examiner*—John Kight, III
*Assistant Examiner*—Garnette D. Draper
*Attorney, Agent, or Firm*—Howson and Howson

[57] ABSTRACT

A foam generating apparatus includes a manifold defined by a rectangular metal block, into which a liquid and surfactant is introduced under very high pressure via a first longitudinally extending passage, and air is introduced via a second longitudinally extending passage parallel to the first passage. The liquid passes through restricted orifices into the narrow ends of a plurality of venturi outlet passages, which are perpendicular to the liquid inlet passage. The velocity of the liquid/surfactant mixture exiting the restricted orifices is maintained sufficiently high to cause flashing to take place to initiate foam generation. Air is injected into the venturi through small diameter ports extending from the second inlet passage to the venturi. The foam and liquid/gas mixture is discharged from the venturis through fittings which may contain vaned inserts for promoting turbulence and thus foaming. Foam production continues in the foam carrying lines downstream of the discharge bushings.

11 Claims, 9 Drawing Figures

FOAM GENERATING APPARATUS AND METHOD

BRIEF SUMMARY OF THE INVENTION

This invention relates to a foam generating apparatus and method.

More specifically, the invention relates to a foam generating apparatus and method for use in dust suppression and freeze conditioning of granular material such as coal, sulphur, fertilizers or base metal ores. A central feature of the apparatus described herein is an apparatus for mixing fluids to produce a foam and a method of operating the apparatus. Searches in the Canadian and U.S. patent literature have failed to disclose anything closely resembling the present apparatus. The most relevant patents disclosed by such searches are U.S. Pat. Nos. 3,120,927, issued to J. H. Holland on Feb. 11, 1964, 4,030,488, issued to J. H. Hasty on June 21, 1977, and 3,811,660, issued to Howard W. Cole, Jr. on May 21, 1974. The Holland and Hasty patents disclose manifold structures. However, the structures are not readily adaptable to the apparatus of the present invention. The Cole patent describes a typical packed chamber foam generating installation for dust suppression.

The object of the present invention is to provide a relatively simple, efficient foam generating apparatus and foam generation and delivery method.

Briefly, the present invention relates to a foam generating apparatus comprising pumping means for delivering a liquid/sufactant mixture at a pressure in the range of approximately 200 to 900 psig, means providing a restricted passage, and a foam conveying line connected to the restricted passage, the pumping means being connected to deliver liquid/surfactant mixture through the restricted passage to the foam conveying line, and means for injecting a gas into the liquid/surfactant mixture downstream of the restriction to produce a foam, the restriction being sufficiently narrow to produce a high flow velocity of the liquid/surfactant mixture such that flashing takes place downstream of the restriction for initiating generation of foam, and such that the foam is continually generated in at least part of the conveying line downstream of the restricted passages.

By using liquid and gas under high pressures, wide area coverage and high penetration of the foam into falling or moving masses of material is effected. When used for dust suppression, a high velocity foam stream creates a venturi effect to draw dust laden air into the stream. At greater distances from the nozzle, there is a large volume of foam covering a large surface area of the material being treated which is a second major means of particle capture. As described more fully hereinafter, surfactants, foaming or other agents or additives can be added to the foam. Polymer-type materials can be added to the foam for residual or long term dust suppression. Even chemicals commonly known as defoamers can be added to the fluid system. The volume of foam applied can be regulated manually or automatically.

In dust suppression and/or the mitigation of freezing and coagulation, certain facts should be considered. In both dust generation and freezing, it is the fines portion of materials which causes problems. Accordingly, the material is preferably treated during free fall to take advantage of naturally occurring segregation in such circumstances. The apparatus of the present invention is capable of projecting a foam stream 15 to 30 feet, depending on the type of nozzle used. This makes the apparatus ideal for use in rotary breakers, crushers, loading or discharge stations on conveyors or bunkers and hoppers receiving material from trains or trucks.

The degree and type of automation utilized with the apparatus is completely arbitrary and can include load sensing, dust density monitoring, material sensing, speed sensing, photocell sensors or virtually any combination of output signals to control pump speed, start/stop or solenoid actuation to vary the foam volume or the locations of the points of application, or the number of points of application.

In the field of dust control, the technique of spraying a dust-producing material with water and a chemical additive is well known. The chemicals used are generally surfactants which change the fluid surface tension, or binders which promote coagulation or the agglomeration of individual particles. Foam has long been recognized as potentially superior to atomized fluid sprays for dust control due to the large surface area presented to the fugitive particulate by the capture medium. The individual foam bubbles must be small in diameter and have a low surface tension in order to capture a maximum of fine dust particles most effectively. This is a major difference from typical fire-fighting foam systems which in general use a very high expansion ratio (gas/liquid), and produce foam with relatively large bubbles to such an extent that a person can breathe with little difficulty while submerged in foam. It should be understood that this difference does not preclude finer dust suppression foam from being used for fire fighting in appropriate circumstances, which generally means confined areas or situations requiring a relatively small volume of foam.

In existing equipment for the generation of foam for dust suppression, air, water and foaming agent (surfactant) are fed through a chamber containing a matrix or maze which causes substantial agitation of the mixture as it is forced through the chamber, thus producing foam. Such systems typically operate in the 100 psi pressure range, and foam conveying lines typically increase substantially in diameter with length. Foam conveying distance is limited, and spurting or pulsation at the foam nozzle is typical, especially on long lines, because the foam tends to segregate over distance back to its fluid and air components.

The present invention eliminates both the mixing chamber and the conveying problems and limitations. The apparatus is designed to handle simple dust suppression agents and/or freeze protection agents which are applied either as foam or in a simple fluid state. Material flow enhancers can also be applied to coal, etc. by this technique.

BRIEF DESCRIPTION OF THE DRAWINGS

The invention will now be described in greater detail with reference to the accompanying drawings, which illustrate a preferred embodiment of the invention, and wherein.

DETAILED DESCRIPTION

Figure 1:
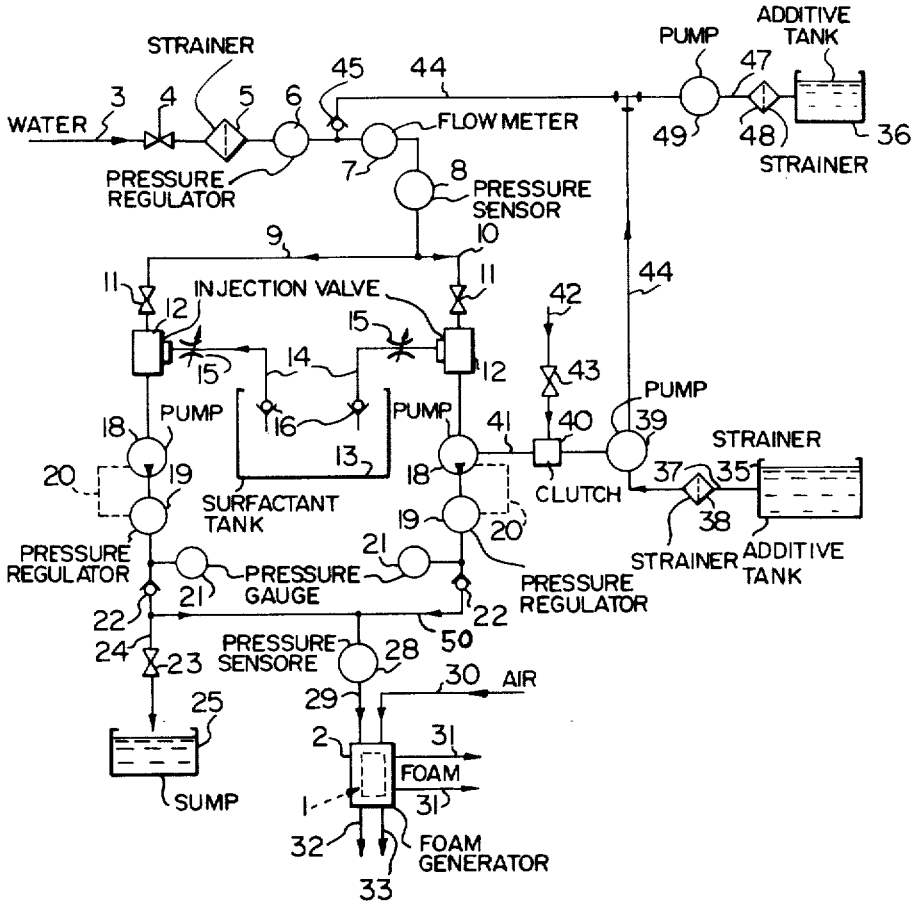
FIG. 1 is a schematic line diagram of a typical system incorporating the foam generating apparatus of the present invention.

With reference to FIG. 1, the apparatus of the present invention includes a manifold generally indicated at 1 housed in a rectangular casing 2. The casing 2 may be a standard electrical enclosure. The manifold 1 and the casing 2 form part of a system, which includes a liquid inlet line 3, which is connected to a source of liquid under pressure (not shown). The liquid passes through an isolation valve 4. The valve 4 is followed by a filter or strainer 5, a pressure regulator 6 and a flow meter 7. A low pressure sensor 8 in the line 3 following the flow meter 7 provides a fluid starvation warning, for stopping pumps before they can be damaged by running dry.

Liquid from the line 3 passes to two pump assemblies via lines 9 and 10. Two assemblies are usually provided so that there is complete back-up if one assembly fails or if extra capacity should be required. Each assembly includes an inlet valve 11, and an injection valve 12 for drawing surfactant from a tank 13 via a line 14 and a variable orifice 15. A check valve 16 in each line 14 prevents the return of surfactant to the tank 13 or the intrusion of other fluid. The flow of fluid through a venturi (not shown) in the injection valve 12 draws surfactant (foaming agent) through the valve 12 in the proportion desired through a metering orifice in the valve 12. The injector valve 12 is followed by a high pressure pump 18 and a pressure regulator 19. Excess liquid is returned from the pressure regulator 19 to the suction side of the pump 18 by a liquid return line 20. A pressure gauge 21 measures the output liquid pressure before the liquid passes through a check valve 22. The check valve 22 prevents the return of air or fluid through the system to the surfactant tank 13. Moreover, the valves 11 and 22 make it possible to remove one pump assembly from service while the other system continues to operate. A blow-down valve 23 in a drain line 24 connected to the line 50 permits the draining of the system. The system is usually drained into a sump 25. Liquid from the line 50 is fed past a pressure sensor 28 in a line 29 to the foam generator manifold 1 where the liquid is mixed with a gas (usually air) introduced through a line 30 to produce foam. The foam is discharged from the foam generator manifold 1 and the casing 2 through lines 31. These lines can be branched to serve several nozzles. The liquid and gas which are not combined to produce foam are discharged from the casing 2 through lines 32 and 33, respectively. This liquid and gas can be conveyed to other foam generators. Passage 65 is provided in manifold 1 for heating means or heating fluid for use in low temperature environments.

If the system is to be used with high viscosity and/or freeze conditioning additives, at least one additive tank is provided. For the sake of simplicity, additive tanks are shown for only one of the pump assemblies. These tanks are indicated as 35 and 36. The additive is pumped from the tank 35 through a line 37 and a strainer 38 by a low pressure chemical pump 39. The pump 39 is connected to shaft 41 of the pump 18 through an air or electrically operated clutch 40. If the clutch 40 is air operated, air is fed into the clutch via a line 42 and a solenoid valve 43. Additive from the tank 35 is pumped through line 44 and check valve 45 to the fluid inlet lines 9 and 10 between the pressure regulator 6 and the flow meter 7. Additive for the line 44 can also be provided by the tank 36 via a line 47, a strainer 48 and a pump 49. The pumps 39 and 49 have a volume displacement capacity proportional to that of the pump 18. The check valve 45 prevents the entry of water into the additive system, and prevents emptying of line 44 when the pump 39 or 49 is not operating.

Figure 2:
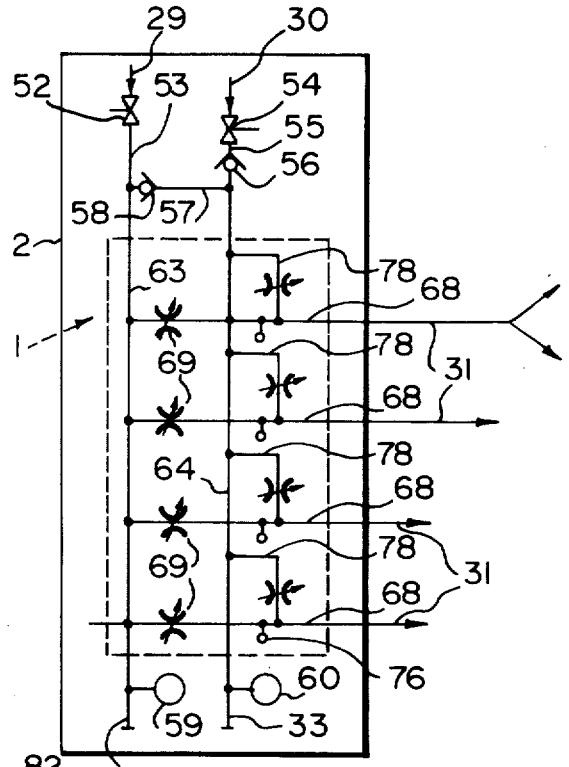
FIG. 2 is a schematic line diagram of a portion of the system of FIG. 1 on a larger scale.

Referring to FIG. 2, the foam generator manifold 1 in the casing 2 receives liquid from the line 29 and a remotely operated valve 52 in an inlet line 53 in the casing 2. Similarly, a remotely operated valve 54 connects the gas line 30 to a gas inlet line 55 in the casing 2. The valves 52 and 54 can be operated manually or remotely. A check valve 56 in the gas inlet line 55 ensures that no high pressure liquid enters line 55 or 30. A line 57 connects the liquid inlet line 53 to the gas inlet line 55 downstream in the direction of gas flow from the valve 56. A check valve 58 in the line 57 prevents liquid from directly entering a longitudinal gas distribution passage 64 in the manifold. When the valve 52 is closed and gas valve 54 is left open for sufficient time, compressed gas in the line 55 flows through the line 57 and the valve 58 to blow liquid out of all downstream lines and passages. This eliminates all problems which would be caused by retained liquid such as freezing and scaling. Liquid and gas pressure gauges 59 and 60 can be provided in the outlet lines 32 and 33, respectively, especially if other foam generators are connected in series. The gauges 59 and 60 monitor pressure drops in the system to determine that sufficient pressures are available for downstream units.

Figure 3:
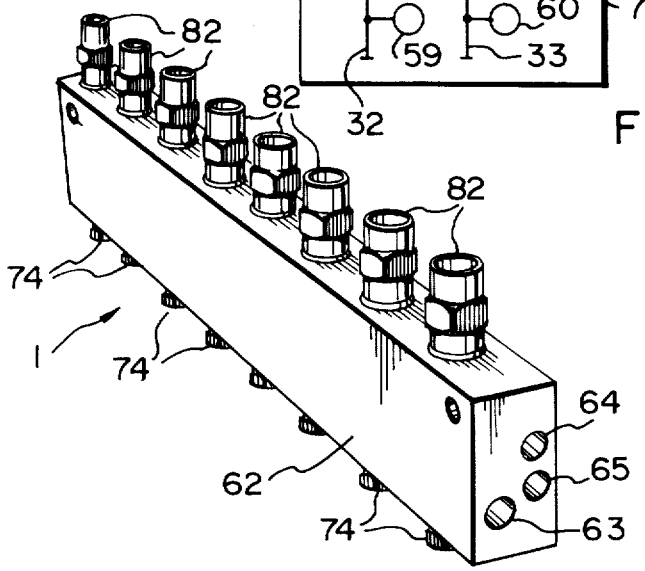
FIG. 3 is a perspective view of a manifold for use in the foam generating apparatus of the present invention.
Figures 6, 7:
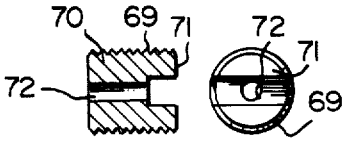
FIG. 6 is a longitudinal sectional view of a metering screw used in the manifold of FIGS. 3 to 5.
FIG. 7 is an end view of the screw of FIG. 6.
Figure 5:
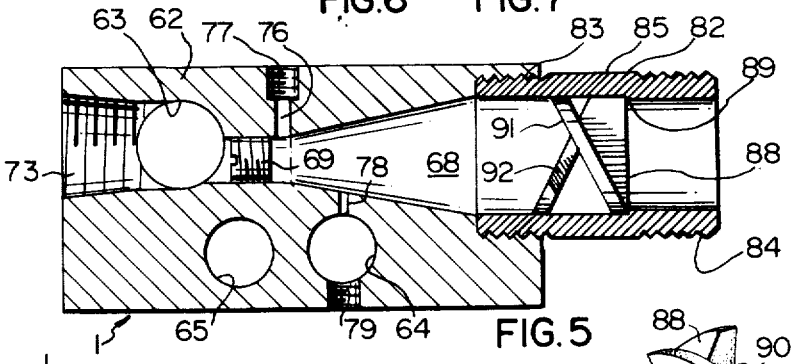
FIG. 5 is a cross section taken generally along lines V—V of FIG. 4.
Figure 9:
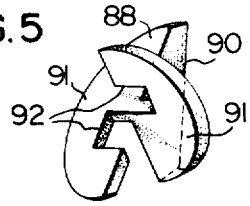
FIG. 9 is a perspective view of a vane insert used in the discharge bushing of FIGS. 3 to 5 and 8.
Figure 4:
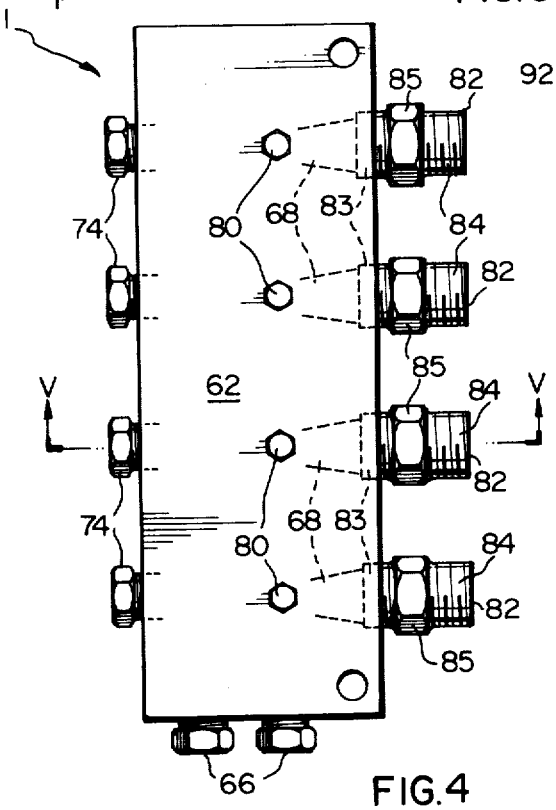
FIG. 4 is a plan view of a manifold similar to, but smaller than the manifold of FIG. 3.
Figure 8:
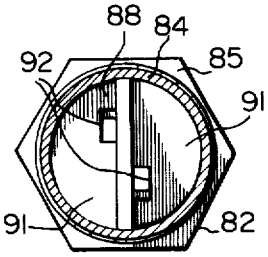
FIG. 8 is an end view of a discharge bushing of FIGS. 3 to 5.

With reference to FIGS. 3 to 9, the manifold 1 is defined by a body 62 in the form of a solid rectangular block of corrosion resistant metal suitable for high pressure use. Longitudinally extending passages 63 and 64 in the body 62 carry liquid and gas through the manifold. An additional longitudinally extending passage 65 is provided to carry heating liquid or coolant, if required. The usual fittings 66 (two shown) are provided at the ends of the passages 63, 64 and 65 for connecting the body to the appropriate inlet and outlet lines. For such purpose, the ends of each passage are threaded for receiving a tapered pipe thread. As best shown in FIG. 5, a single or a plurality of inwardly tapering, venturi outlet passages 68 intersect the liquid passage 63. A screw 69 is provided at the narrow inner end of each outlet passge 68. The screw 69 (FIGS. 6 and 7) has a cylindrical threaded body 70 with a slotted or hexagonal end 71, and a longitudinally extending port 72 defining a metering orifice. The size of the metering orifice can readily be changed by replacing one screw 69 with another screw having a larger diameter port 72. If one or more of the metering orifices is not required, the screw 69 can be replaced by a blank plug, and the outlet passage 68 is capped. Access to the screws 69 is gained through ports 73 in the side of the body 62 opposite the outlet passages 68 or through the outlet passages 68. The ports are normally closed by hexagonal headed screws 74 (FIGS. 3 and 4). Alternatively, the ports 73 can be used as liquid inlets. A passage 76 intersects each venturi outlet passage 68 immediately downstream of the screw 69 in the low pressure area of the venturi. The outer end 77 of the passage is threaded, so that the passage 76 can be plugged or used as an aspiration port for gas or liquid because of the negative pressures developed in the low pressure area.

Gas is introduced into the outlet passage 68 from the passage 64 through a restricted orifice 78. Access to the passage 64 and the orifices 78 is gained through threaded ports 79 in the body 62 opposite the orifices 78. The ports 79 are normally closed by plugs 80 (FIG. 4).

The discharge bushing 82 (FIGS. 5 and 8) is mounted in the outlet end of each passage 68. Each discharge bushing is defined by a short tubular body with externally threaded ends 83 and 84. Alternatively, the discharge bushing can be a quick-disconnect fitting. The threaded end 83 extends into the body 62. The outer threaded end 84 permits the attachment of foam conveying lines 31 to the body 62. The center 85 of the bushing 82 is hexagonal for facilitating insertion and removal of the bushing 82. A turbulence producing insert 88 (FIG. 9) is provided in each bushing 82 only in cases where very short foam delivery lines are used. An interior shoulder 89 in the bushing 82 prevents expulsion of the insert 88. The insert 88 includes a solid body with a generally triangular rib 90 at one end for bearing against the shoulder 89 and a pair of inclined, semicircular vanes 91 at the other end extending into the path of travel of the liquid/gas mixture produced in the passage 68. Rectangular slots 92 are provided in the straight inner edges of vanes 91 to increase the open passage sectional area of 88. These vanes 91 assist in generating turbulence by forcing flow into a vortex.

OPERATION

In typical operation, a liquid mixture of water, or other fluid, and surfactant is introduced into the manifold 1 via line 29, valve 52 and line 53, and air is introduced via line 30, valve 54 and line 55 and/or through the port 76. By changing the screw 69 to change the diameter of the liquid inlet port 72, the volume of foam being produced can be increased or decreased. The diameter of the gas injection port 78 can also be increased to increase foam volume, or gas pressure can be increased.

Pumps 18 are high pressure pumps, and the pumping assemblies deliver water/surfactant mixture through line 29 to the foam generator manifold at a pressure of at least approximately 200 psig and preferably between approximately 400 and 900 psig. As the mixture passes through the restricted inlet port 72 in screw 69, its velocity is greatly increased as a result of the reduction in the cross-section area of the liquid passage as compared to the sectional area of 63.

The minimum cross-section of the liquid stream, i.e. the vena contracta, is located just downstream of the restriction in the liquid passage. The liquid velocity at the vena contracta is so high that pressure drops far below the vapor pressure of the water/surfactant mixture. This low pressure gives rise to a condition known as "flashing", which is low pressure boiling, characterized by the violent formation of bubbles in the mixture. This phenomenon is well known and carefully avoided in normal hydraulic design due to the destructive effects flashing and the associated cavitation have on adjacent solid material. The increasing diameter of 68 protects that body from the effects of flashing. It is the formation of these bubbles which is the initiation of foaming.

Air is introduced through air injection port 78 adjacent to the vena contracta. It is not necessary for the air to be introduced under high pressure, because it is drawn in by the vacuum created at the vena contracta. In fact, ambient air can be drawn in through port 78. The volume of air introduced into the liquid is to some extent self-regulated. That is, it is regulated by the velocity and volume of liquid passing through passage 72. Other materials and fluids can, of course, be drawn in by the vacuum, if desired.

The application of a pressure in the range of approximately 200 to 900 psi to the liquid/surfactant mixture upstream of the foam generator results not only in the flashing conditions described above for the initiation of foam generation, but also in the maintenance of a high Reynolds number, velocity and turbulence in the foam conveying lines 31 so that foam is continuously generated in the foam conveying lines downstream of the discharge bushings 82 throughout at least a substantial part of lengths of the lines. Maintaining a high Reynolds number in the conveying lines 31 reduces or prevents foam degradation and surging. In the case of water-based foam the Reynolds number in the foam conveying lines should be at least approximately 4500 and preferably about 5000 or more. Where short foam conveying lines are used, inserts 88 are helpful in promoting turbulence in the conveying lines. With longer conveying lines, however, better results are achieved by eliminating the inserts and their attendant pressure drop.

Foam generating methods used heretofore produce a finished foam product in a turbulence or expansion chamber usually referred to as a "packed cylinder" foam generator, and attempt to convey a highly degradable product through delivery lines. The delivery lines typically range from one to three inches in diameter. Every effort is made to handle the foam gently to reduce degradation in the delivey lines. Turbulence is avoided to the extent it is possible to do so. In many cases the delivery lines are designed so that they become larger in diameter with distance from the foam generator.

The present invention differs from prior foam generating methods and apparatus in numerous respects and especially in that it initiates foam by flashing and prevents foam degradation in the foam conveying lines by producing conditions under which foam generation continues to take place in the conveying lines by reason of the turbulent conditions maintained in those lines. The system has the advantage of at least approximately three times greater efficiency over systems using packed chambers previously available, and it also has the advantage that the high velocities in the foam conveying lines make it possible to project foam from the foam nozzles over a greater distance. Another advantage of the invention is that standard small diameter hydraulic hose or metal tubing may be used to convey the foam. This minimizes installation problems, costs and potential freezing problems.

The ability of the invention to prevent foam degradation in delivery lines is especially important where multiple delivery points are required.

Because of the small size of the foam generator in relation to its output capacity; a 2"×2"×4" device can easily produce 300 gallons per minute of quality foam, and in conjunction with high velocity conveying techniques, the unit can be used on longwall and continuous miners in a unique way. Existing patents claiming usefullness on underground miners locate the apparatus somewhere on or near the machine and then convey foam through dedicated external hoses to nozzles which direct the foam towards the working face, the dust producing area. The foam lines and apparatus are subject to severe abuse and are likely to be destroyed in a very short time.

All underground miners use water for cooling their motors and transformers as well as for dust suppression. Special water spray nozzles for high pressure, typically 300 to 500 psig., are located on the cutting heads between and/or adjacent to the shearing teeth. Usually, some nozzles are aimed straight at the cutting bits to provide cooling and lubrication, while others, with a cone pattern are intended mainly for dust control. The water reaches these nozzles via a network of passages built into the rotating equipment's shafts and housings linked together with high pressure hoses and swivel joints. Water is usually pumped to the miners through very long runs of pipe and hose, often thousands of feet.

To generate foam on an underground miner, a compessed air line would have to parallel the fluid delivery line on the miner. At any point in the water delivery system, an appropriate volume or proportion of chemical can be introduced via a high pressure chemical injection pump. With this invention, to minimize the problem of handling bulk chemicals underground, the water/chemical ratio is kept in the 400 to 600 to 1 range as opposed to 100 to 1 usually used on above ground foam installations.

In accordance with this invention one or more foam generators, may be mounted on the miner. The generator manifold(s) are as previously described internally, but externally are contoured and oriented to fit under the miner's heavy steel cover plates, thus becoming an internal and protected component. Ultimately, the "flashing chamber" could be machined into existing shafts. Most of the water/chemical mixture is fed through the foam generator, with a small amount being diverted to the machine's cooling circuits. Air introduced at the foam generator produces foam, as previously described, which flows through the miner's existing internal passages to the nozzles. The orifice size of the nozzles has to be increased to accommodate the larger volume of fluid now being produced, but the passages are suitable to achieve the high Reynolds number previously described. A longwall miner typically uses 70 to 100 GPM of water for dust control and cooling. When converted to foam generation, 5 to 10 GPM of liquid is diverted to cooling and approximately 30 GPM to foam production. This 30 GPM of liquid produces approximately 900 GPM of foam, with a corresponding influence on dust control.

I claim:

1. A foam generating apparatus comprising pumping means for delivering a liquid/surfactant mixture at a pressure in the range of approximately 200 to 900 psig, means providing a restricted passage, and a foam conveying line connected to the restricted passage, the pumping means being connected to deliver liquid/surfactant mixture through the restricted passage to the foam conveying line, and means for injecting a gas into the liquid/surfactant mixture downstream of the restriction to produce a foam, the restriction being sufficiently narrow to produce a high flow velocity of the liquid/surfactant mixture such that flashing takes place downstream of the restriction for initiating generation of foam, and such that the foam is continually generated in at least part of the conveying line downstream of the restricted passages.

2. A foam generating apparatus according to claim 1 in which the means for injecting a gas into the liquid/surfactant mixture comprises means providing a venturi passage arranged to convey liquid/surfactant mixture from the pumping means to the conveying line, the means providing a restricted passage being located in said venturi passage and the means providing a venturi passage having a transverse passage for drawing gas into the liquid/surfactant stream at a location downstream of said restricted passage but within the verturi passage.

3. A foam generating apparatus according to claim 1 in which the means providing a restricted passage comprises a housing with a flow passage and a removable insert located in said flow passage, said restricted passage being an opening in the insert.

4. A foam generating apparatus according to claim 1 in which the means providing a restricted passage comprises a housing, and including additional passage means in said housing for receiving a thermal fluid or heating element for controlling the temperature of the liquid/surfactant mixture, and the gas.

5. A foam generating apparatus according to claim 1 including additional pumping means for introducing chemical additives into said liquid/surfactant mixture, and means for operating said additional pumping means in synchronism with said pumping means for delivering the liquid/surfactant mixture, whereby the proportion of chemical additives in the liquid/surfactant mixture may be controlled at a constant level.

6. A foam generating apparatus comprising pumping means for delivering a liquid/surfactant mixture at a pressure in the range of approximately 200 to 900 psig, manifold means, means within said manifold means providing a plurality of restricted passages, a plurality of foam conveying lines, each restricted passage having one of said conveying lines connected to it, means connecting the pumping means to said restricted passages for delivery of liquid/surfactant mixture through said restricted passages to the foam conveying lines in parallel paths, and means for injecting a gas into the liquid/surfactant mixture downstream of the restriction in each passage to produce a foam, each restriction being sufficiently narrow to produce a high flow velocity of the liquid/surfactant mixture such that flashing takes place downstream of the restriction for initiating generation of foam, and such that the foam is continually generated in at least part of each of the conveying lines downstream of the restricted passages.

7. A foam generating apparatus according to claim 6 including passage means in said manifold for receiving a thermal fluid or heating element for controlling the temperature of the liquid/surfactant mixture and the gas.

8. A foam generating apparatus according to claim 6 in which said manifold is elongated in which said restricted passages extend substantially perpendicular to the length of the manifold, and having a first inlet passage extending substantially parallel to the length of the manifold for delivering liquid/surfactant mixture to the restricted passages, and a second passage extending substantially parallel to the length of the manifold for delivering gas immediately downstream of said restricted passages.

9. A method of generating foam comprising the steps of forcing a mixture of liquid and a surfactant through a restricted passage at a pressure on the upstream side of the passage such that the velocity of the mixture on the downstream side results in flashing of the mixture, and introducing a gas into the mixture on the downstream side of the restricted passage in the region of the vena contracta to produce a foam.

10. A method according to claim 9 including the step of passing the foam through a foam conveying line while maintaining the velocity of said mixture on the downstream side of the restricted passage at a level such as to cause continuous generation of foam in the foam conveying line throughout at least a substantial part of its length.

11. A method of generating foam comprising the steps of forming a foam in a foam generator from a mixture of a liquid, a surfactant, and a gas, and delivering the foam thus generated through a foam conveying line, while maintaining a sufficiently high Reynolds number in at least part of the conveying line to produce continued generation of foam in said line.

* * * * *